US008933373B2

(12) United States Patent
Yamamoto

(10) Patent No.: US 8,933,373 B2
(45) Date of Patent: Jan. 13, 2015

(54) CERAMIC HEATER

(75) Inventor: Ken Yamamoto, Kirishima (JP)

(73) Assignee: Kyocera Corporation, Kyoto-Shi, Kyoto (JP)

( * ) Notice: Subject to any disclaimer, the term of this patent is extended or adjusted under 35 U.S.C. 154(b) by 328 days.

(21) Appl. No.: 13/499,382

(22) PCT Filed: Oct. 27, 2010

(86) PCT No.: PCT/JP2010/069036

§ 371 (c)(1),
(2), (4) Date: May 29, 2012

(87) PCT Pub. No.: WO2011/052624

PCT Pub. Date: May 5, 2011

(65) Prior Publication Data

US 2012/0234823 A1 Sep. 20, 2012

(30) Foreign Application Priority Data

Oct. 27, 2009 (JP) ..... 2009-246042

(51) Int. Cl.

| | |
|---|---|
| ***F23Q 7/22*** | (2006.01) |
| ***H05B 3/10*** | (2006.01) |
| ***H05B 3/18*** | (2006.01) |
| ***H05B 3/48*** | (2006.01) |
| ***F23Q 7/00*** | (2006.01) |

(52) U.S. Cl.

CPC *H05B 3/48* (2013.01); *F23Q 7/001* (2013.01); *H05B 2203/027* (2013.01)

USPC ..... 219/270; 219/544

(58) Field of Classification Search

None

See application file for complete search history.

(56) References Cited

U.S. PATENT DOCUMENTS

| | | | | |
|---|---|---|---|---|
| 4,502,430 | A * | 3/1985 | Yokoi et al. | 123/145 A |
| 7,772,525 | B2 * | 8/2010 | Annavarapu et al. | 219/260 |
| 2002/0036192 | A1 | 3/2002 | Sato et al. | |
| 2002/0162831 | A1 * | 11/2002 | Taniguchi et al. | 219/270 |
| 2003/0029856 | A1 | 2/2003 | Tatematsu et al. | |
| 2006/0213897 | A1 * | 9/2006 | Annavarapu et al. | 219/270 |
| 2008/0210684 | A1 | 9/2008 | Kukino et al. | |

(Continued)

FOREIGN PATENT DOCUMENTS

| | | |
|---|---|---|
| JP | 10110951 | 4/1998 |
| JP | 2003040678 | 2/2003 |

(Continued)

OTHER PUBLICATIONS

Yamamoto, "Ceramic Heater," Oct. 2007, partial translation.*

(Continued)

*Primary Examiner* — Joseph M Pelham

(74) *Attorney, Agent, or Firm* — Volpe and Koenig, P.C.

(57) ABSTRACT

Provided is a highly durable ceramic heater capable of suppressing development of cracks in a base body resulting from a difference in thermal expansion between the ceramic-made base body and a heat generating element. A ceramic heater of the invention includes a ceramic base body and a heat generating resistor including a heat generation section composed of a bend portion and two rectilinear portions extending from opposite ends of the bend portion, respectively, the heat generating resistor being embedded within the ceramic base body. The two rectilinear portions include inner sides opposed to each other in a transverse section, and the inner sides include recesses in at least a midportion.

3 Claims, 7 Drawing Sheets

(56) References Cited

U.S. PATENT DOCUMENTS

| | | | | |
|---|---|---|---|---|
| 2009/0173729 | A1* | 7/2009 | Annavarapu et al. | 219/270 |
| 2009/0194519 | A1 | 8/2009 | Funaki et al. | |

FOREIGN PATENT DOCUMENTS

| | | |
|---|---|---|
| JP | 2005340034 | 12/2005 |
| JP | 2007265893 | 10/2007 |
| JP | 2007335397 | 12/2007 |

OTHER PUBLICATIONS

Murai, "Glow Plug and its Manufacture," Apr. 1998, partial translation.*

Statement of Relevance and Chinese Office Action, Chinese Patent Application No. 201080041038.3, May 30, 2013, 5 pp.

Statement of Relevance and Japanese Office Action, Japanese Patent Application No. 2011-538450, May 14, 2013, 5 pp.

Japanese Office Action, Japanese Patent Application No. 2011-538450, May 14, 2013, 2 pp.

* cited by examiner

CERAMIC HEATER

TECHNICAL FIELD

The present invention relates to a ceramic heater for use in, for example, an ignition heater of an oil fan heater, a glow plug for use in assistance to the starting of diesel engine operation, and so forth.

BACKGROUND ART

Ceramic heaters have hitherto been used for various applications, as typified by an ignition heater of an oil fan heater and a glow plug for use in assistance to the starting of diesel engine operation. For example, such a ceramic heater is constructed by embedding a heat generating element made of electrically conductive ceramics in a base body made of insulating ceramics. As the material of construction of the heat generating element in such a ceramic heater, there is known a substance composed predominantly of at least one of a silicide of molybdenum or tungsten, a nitride of the same, and a carbide of the same. Moreover, as the material of construction of the base body, there is known a substance composed predominantly of silicon nitride.

However, since the material of construction of the heat generating element is commonly greater in thermal expansion coefficient than the material of construction of the base body, there is the possibility that a crack will appear in the base body due to a thermal stress generated between these materials at the time of heat liberation. With this in view, the addition of a rare-earth component, a silicide of chromium, and an aluminum component to the material for the base body has been proposed as a technique to minimize the difference in thermal expansion coefficient between those materials (refer to Patent Literature 1, for example).

CITATION LIST

Patent Literature

Patent Literature 1: Japanese Unexamined Patent Publication JP-A 2007-335397.

SUMMARY OF INVENTION

Technical Problem

However, in the conventional-type ceramic heater as described above, even though the difference in thermal expansion coefficient between the heat generating element and the base body is small, if the flow of an electric current of substantial magnitude takes place under abnormal conditions, a great thermal stress will be generated. This gives rise to the problem of development of cracks in the interior of the base body.

The invention has been devised to overcome such a problem associated with the conventional ceramic heater as mentioned supra, and accordingly its object is to provide a highly durable ceramic heater capable of suppressing development of cracks in a base body resulting from a difference in thermal expansion between the ceramic-made base body and a heat generating element.

Solution to Problem

The invention provides a ceramic heater, comprising: a ceramic base body; and a heat generating resistor comprising a heat generation section composed of a bend portion and two rectilinear portions extending from opposite ends of the bend portion, respectively, the heat generating resistor being embedded within the ceramic base body, wherein the two rectilinear portions comprise inner sides opposed to each other in a transverse section, and the inner sides comprise recesses in at least a midportion.

In addition, it is preferable that, in the two rectilinear portions, the inner sides comprise curvilinear recesses in at least the midportion.

Moreover, it is preferable that outer sides of the two rectilinear portions are curved in the transverse section thereof.

Moreover, it is preferable that each of the two rectilinear portions has a crescentic shape in the transverse section thereof.

Moreover, it is preferable that a contour of the transverse section of the ceramic base body at a location where the two rectilinear portions are arranged bears no geometric similarity to a shape of a region lying between wall surfaces of the recesses.

Moreover, it is preferable that the bend portion is identical in a transverse sectional configuration with the rectilinear portion.

Further, it is preferable that, in the heat generating resistor, a resistance of the heat generation section is higher than that of other portions.

Advantageous Effects of Invention

According to the ceramic heater of the invention, the two rectilinear portions comprise inner sides opposed to each other in a transverse section, and the inner sides comprise recesses in at least a midportion. This helps increase the area of the inner sides opposed to each other. Moreover, since the inner side profile is not defined by a straight line when viewed in cross section, it is possible to achieve dispersion of a stress resulting from volume expansion of part of the ceramic base body partitioned by at least the midportion (recesses) of the inner sides opposed to each other, and thus relax the stress by virtue of a cushioning effect exerted by the heat generation section. Accordingly, in the event of sudden voltage application under abnormal conditions, it is possible to prevent development of cracks resulting from volume expansion of the ceramic base body at its region lying between parts of the heat generation section.

DESCRIPTION OF EMBODIMENTS

Hereinafter, examples of a ceramic heater according to one embodiment of the invention will be described in detail with reference to the drawings.

Figure 1:
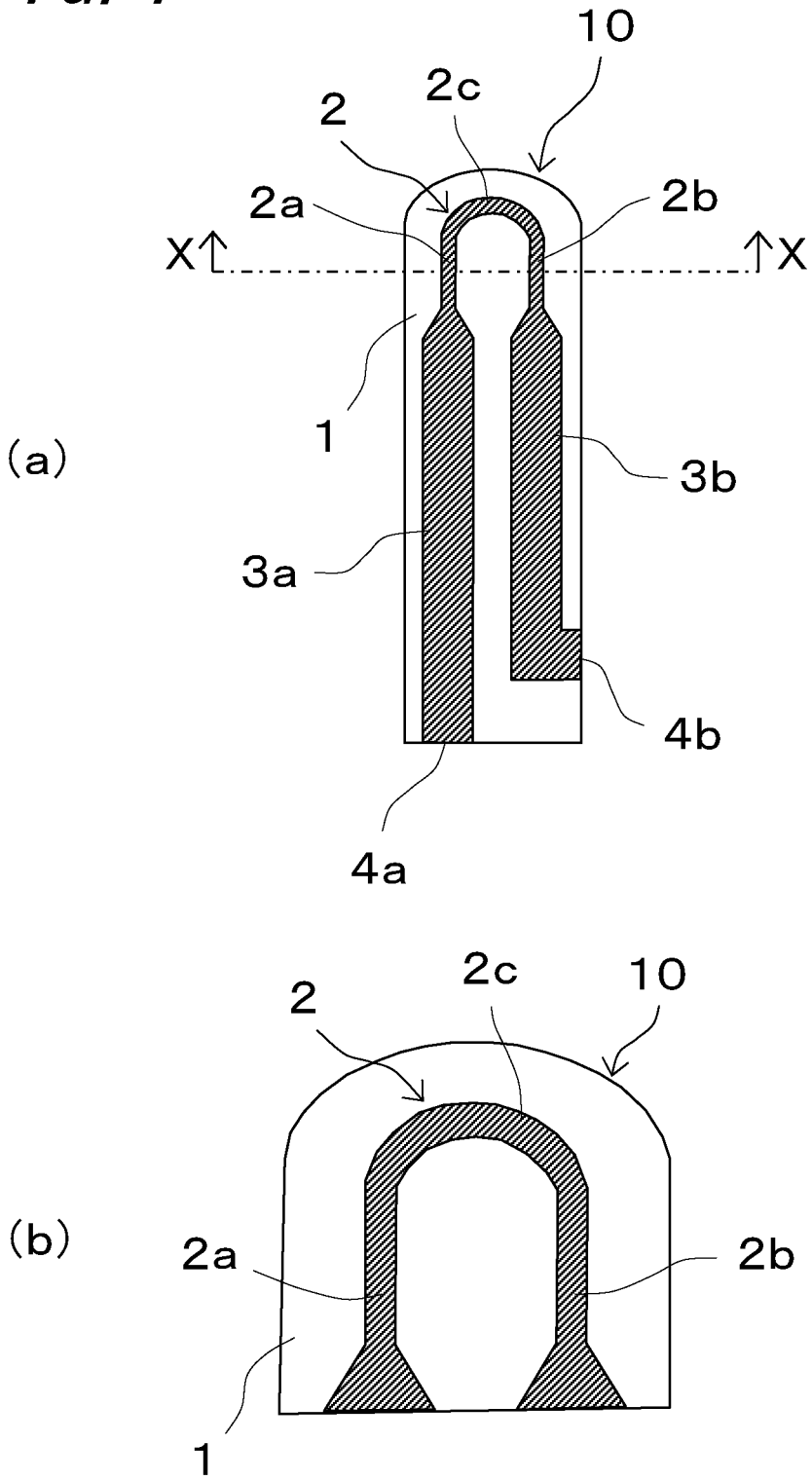
FIG. 1(*a*) is a plan view showing an example of a ceramic heater according to one embodiment of the invention in a see-through manner, and FIG. 1(*b*) is an enlarged view showing a main part of the ceramic heater.
Figure 2:
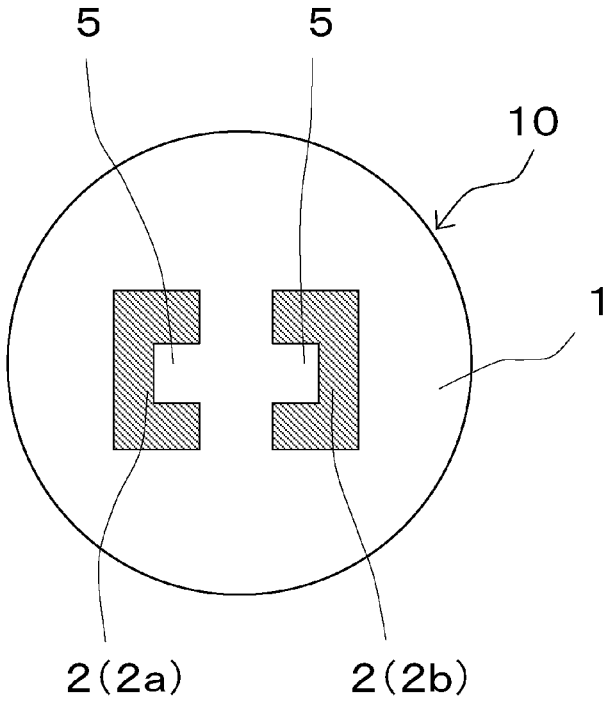
FIG. 2 is a sectional view of the ceramic heater shown in FIG. 1 taken along the line X-X of FIG. 1.

FIG. 1(*a*) is a plan view showing an example of a ceramic heater according to one embodiment of the invention in a see-through manner, and FIG. 1(*b*) is an enlarged view showing a main part of the ceramic heater. FIG. 2 is a sectional view of the ceramic heater shown in FIG. 1 taken along the line X-X of FIG. 1.

A ceramic heater 10 of this example comprises a ceramic base body 1, and a heat generating resistor having a heat generation section 2 composed of a bend portion 2*c* and two rectilinear portions 2*a* and 2*b* extending from the opposite ends of the bend portion 2*c*, respectively, the heat generating resistor being embedded within the ceramic base body. As shown in the figures, in the case where the heat generating resistor is embedded within the rod-like ceramic base body 1, the heat generating resistor is embedded, with its bend portion 2*c* located at the front end of the ceramic base body 1. The bend portion 2*c* is arcuately shaped when viewed in a plan view, and the rectilinear portions 2*a* and 2*b* are parallel portions, or equivalently arranged in parallel with each other when viewed planarly. The heat generation section 2 composed of the bend portion 2*c* and the rectilinear portions 2*a* and 2*b* is formed in a U-shape.

As the material for forming the ceramic base body 1, alumina ceramics or silicon nitride ceramics is desirable for use because of its excellence in insulation capability under high-temperature conditions. In terms of its high durability under rapid temperature rise, silicon nitride ceramics is particularly desirable. The composition of silicon nitride ceramics has a form in which main crystal phase grains composed predominantly of silicon nitride ($Si_3N_4$) have been bonded together by a grain boundary phase derived from a sintering aid component or the like. The main crystal phase may be of the type in which part of silicon (Si) or nitrogen (N) may be substituted with aluminum (Al) or oxygen (O), and may also contain therein metal elements such as Li, Ca, Mg, Y, and so forth in the form of solid solution.

On the other hand, as the material for forming the heat generation section 2, electrically conductive ceramics such for example as tungsten carbide (WC), molybdenum disilicide ($MoSi_2$), and tungsten disilicide ($WSi_2$) can be used.

Moreover, the rectilinear portions 2*a* and 2*b* constituting the heat generation section 2 are connected, at their ends, with lead portions 3*a* and 3*b*, respectively. When the heat generation section 2 receives electric current that has been passed through the lead portions 3*a* and 3*b*, the heat generation section 2 produces heat. More specifically, the lead portions 3*a* and 3*b* are preferably made of the same material as that used for the heat generation section 2, are so formed as to merge with the rectilinear portions 2*a* and 2*b* constituting the heat generating section 2, respectively, while extending in substantially the same direction, are made larger in diameter than the heat generation section 2, and are made lower in resistance per unit length than the heat generation section 2 to suppress unnecessary heat liberation. In FIG. 1, an end face of the lead portion 3*a* opposite the end face thereof connected to the rectilinear portion 2*a* is exposed at the base end part of the ceramic base body 1, thereby constituting an electrode-taking portion 4*a*. Moreover, an end face of the lead portion 3*b* opposite the end face thereof connected to the rectilinear portion 2*b* is exposed at a lateral side of the ceramic base body 1, thereby constituting an electrode-taking portion 4*b*. Note that the heat generation section 2 and the lead portion 3*a*, 3*b* may be formed independently as separate components of different compositions. Also in this case, the lead portions 3*a* and 3*b* are made lower in resistance per unit length than the heat generation section 2 to suppress unnecessary heat liberation.

As shown in FIG. 2, the two rectilinear portions comprise inner sides opposed to each other in a transverse section, and the inner sides comprise recesses in at least a midportion (hereafter, at least the midportion of the inner sides opposed to each other of the two rectilinear portions will be referred to as "recesses 5").

In a conventional ceramic heater devoid of such recesses formed at least in the midportion of the opposed inner sides of the two rectilinear portions 2*a* and 2*b* in the transverse section of the heat generation section 2, in the event of sudden voltage application under abnormal conditions, a stress resulting from volume expansion of part of the ceramic base body partitioned by the opposed inner sides could cause a crack to occur in the ceramic base body at the interface between the ceramic base body and the heat generation section.

By way of contrast, according to the ceramic heater 10 of the present example, the two rectilinear portions 2*a* and 2*b* comprise inner sides opposed to each other in a transverse section, and the inner sides comprise recesses in at least a midportion (the recesses 5 are formed at least in the midportion of the inner sides opposed to each other). This helps increase the area of the inner sides opposed to each other. Moreover, since the inner side profile is not defined by a straight line when viewed in cross section, it is possible to achieve dispersion of a stress resulting from volume expansion of part of the ceramic base body 1 partitioned by at least the midportion (recesses) of the inner sides opposed to each other, and thus relax the stress by virtue of the cushioning effect exerted by the heat generation section 2. Accordingly, in the event of sudden voltage application under abnormal conditions, it is possible to prevent development of cracks resulting from volume expansion of the ceramic base body 1 at its region lying between parts of the heat generation section.

As used herein, the expression like "the inner sides comprise recesses in at least the midportion" may be taken to mean that the recesses 5 can either be formed only in the midportion of the inner sides opposed to each other or formed so as to extend over substantially the entire inner side. In other words, the opening of the recesses 5 can either be located only in the midportion of the inner sides opposed to each other or located substantially throughout the inner sides. Note that, in FIG. 2, the other regions of the opposed inner sides of the two rectilinear portions 2*a* and 2*b* than the regions each formed with the recesses 5 are made as flat surfaces and are opposed in parallel to each other. Such a configuration can be obtained by a press molding technique or injection molding technique as will hereafter be described.

Even in the form of a slightly concaved part, the recesses 5 are able to exert a certain effect. It will be found desirable, however, to set the depth of the recess 5 to be greater than or equal to 3% of the thickness of the rectilinear portion 2*a*, 2*b* in a widthwise direction (in the horizontal direction viewing FIG. 2) (the thickness of the rectilinear portion 2*a*, 2*b* in the widthwise direction under the assumption that the recess 5 does not exist) in the transverse section thereof, for the sake of producing a cushioning effect, as well as to set the depth of the recess 5 to be less than or equal to 50% of the thickness of the rectilinear portion 2*a*, 2*b* in the widthwise direction (in the horizontal direction viewing FIG. 2) (the thickness of the rectilinear portion 2*a*, 2*b* in the widthwise direction under the assumption that the recess 5 does not exist) in the transverse section thereof, for the sake of preventing localized heat liberation.

Moreover, it is preferable that the length of the opening of the recess 5 in a heightwise direction (in the direction from top to bottom or vice versa, or vertical direction viewing FIG. 2) is greater than or equal to 5%, but less than or equal to 70% from the cushioning-effect standpoint, of the thickness of the parallel portion 2*a*, 2*b* in the heightwise direction (in the vertical direction viewing FIG. 2) (the thickness of the rectilinear portion 2*a*, 2*b* in the heightwise direction under the assumption that the recess 5 does not exist) in the transverse section thereof.

It is also preferable that the recess 5 is so formed as to extend over the entire length of the heat generation section 2 (both the bend portion 2*c* and the rectilinear portions 2*a* and 2*b*) for the sake of maximizing the cushioning effect.

Figure 3:
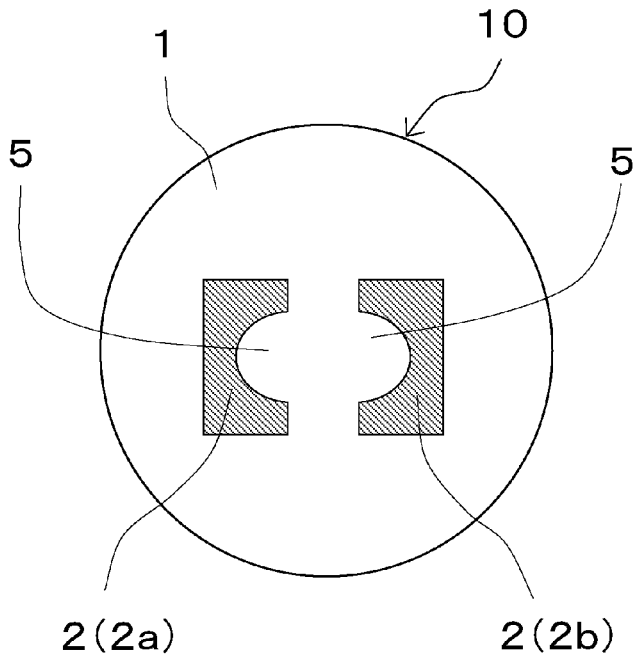
FIG. 3 is a transverse sectional view showing another example of the ceramic heater according to one embodiment of the invention.

In the ceramic heater 10 of the invention, as shown in FIG. 3, it is preferable that in the rectilinear portions 2*a* and 2*b* constituting the heat generation section 2, the inner sides opposed to each other comprise curvilinear recesses in at least the midportion (recesses 5).

As used herein, the expression like "curvilinear recess" may be taken to mean that the recess 5 has no point of inflection at its inner surface. The curvilinear recess is preferably defined by a smooth curve, or arc rather than a rounded-corner angular figure. Just as is the case with the form shown in FIG. 2, in order to prevent localized heat liberation, it is preferable that the depth of the recess 5 is less than or equal to 50% of the thickness of the rectilinear portion 2*a*, 2*b* in the widthwise direction (in the horizontal direction viewing FIG. 3) (the thickness of the rectilinear portion 2*a*, 2*b* in the widthwise direction under the assumption that the recess 5 does not exist) in the transverse section thereof. By adopting such a form, it is possible to render the recess 5 free of a point of inflection which is susceptible to cracking under stress concentration, and thereby suppress development of cracks in the ceramic base body 1 more reliably.

Figure 4:
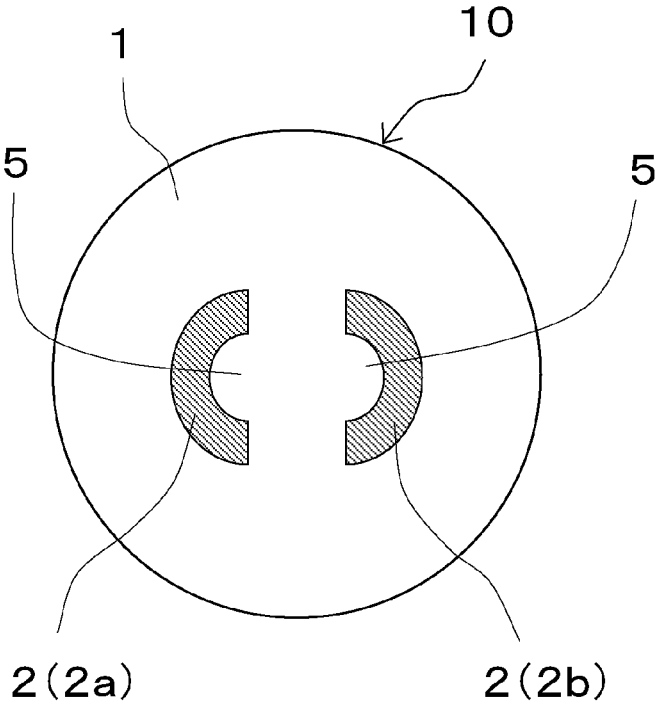
FIG. 4 is a transverse sectional view showing still another example of the ceramic heater according to one embodiment of the invention.

Moreover, in the ceramic heater 10 of the invention, as shown in FIG. 4, it is preferable that outer sides of the two rectilinear portions 2*a* and 2*b* are curved in the transverse section thereof.

As used herein, the expression like "outer sides . . . are curved" may be taken to mean that the outer side has no point of inflection. The curved outer side preferably assumes a smoothly curved configuration, rather than a rounded-corner angular configuration. By adopting such a form, it is possible to render the outer sides of the two rectilinear portions 2*a* and 2*b* free of a point of inflection which is susceptible to cracking under stress concentration, and thereby suppress development of cracks in the ceramic base body 1 more reliably.

Figure 5:
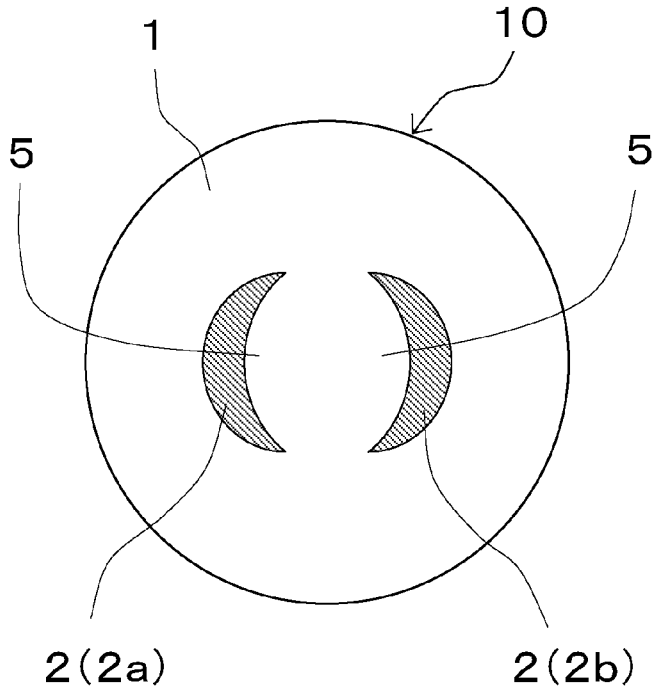
FIG. 5 is a transverse sectional view showing still another example of the ceramic heater according to one embodiment of the invention.

Further, in the ceramic heater 10 of the invention, as shown in FIG. 5, it is preferable that the two rectilinear portions 2*a* and 2*b* have a crescentic shape in the transverse section thereof. In this case, the thin and sharp ends of the crescentic shape become the first to liberate heat upon voltage application. Since the thin and sharp ends are arranged substantially equidistantly in the direction of length of the heat generation section 2, it follows that the ceramic base body 1 is raised in temperature uniformly throughout its entire area, with consequent speeding-up of uniformization in the temperature distribution of the ceramic heater 10 in its circumferential direction. It is therefore particularly desirable that the thin and sharp ends of the crescentic form should be spaced equally from the circumference of the transverse section of the ceramic heater 10. As will hereafter be described, it is preferable that the region between the recesses 5 of the two rectilinear portions 2*a* and 2*b* having a crescentic shape in the transverse section thereof is defined by a crescent figure which bears no geometric similarity to a contour of the transverse section of the ceramic base body 1.

Figure 6:
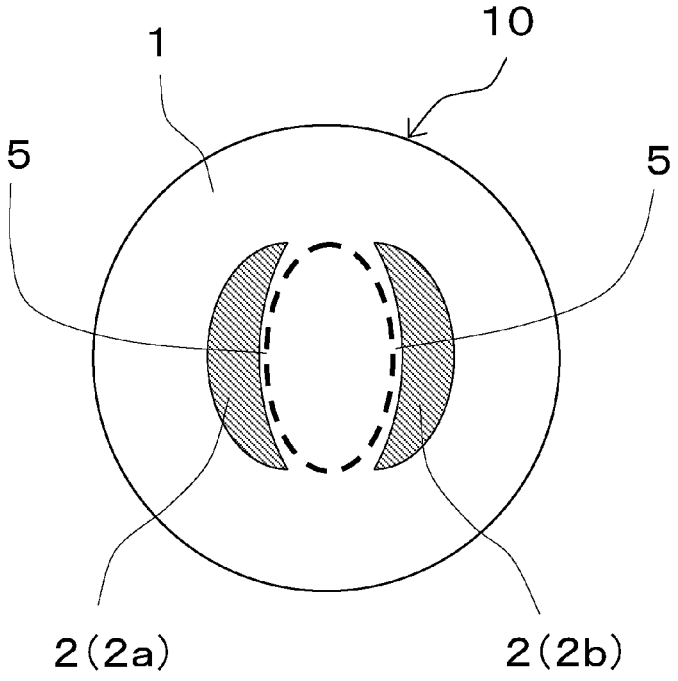
FIG. 6 is a transverse sectional view showing still another example of the ceramic heater according to one embodiment of the invention.

That is, in the ceramic heater 10 of the invention, as shown in FIG. 6, it is preferable that the contour of the transverse section of the ceramic base body 1 involving the rectilinear portions 2*a* and 2*b* of the heat generation section 2 bears no geometric similarity to a shape of a region lying between the recessed wall surfaces formed at least in the midportion (recesses 5) of the opposed inner sides of the two rectilinear portions 2*a* and 2*b*, respectively. In other words, it is preferable that the contour of the transverse section of the ceramic base body 1 at a location where the two rectilinear portions 2*a* and 2*b* are arranged bears no geometric similarity to the shape of the region lying between the recessed wall surfaces formed at least in the midportion (recesses 5) of the opposed inner sides of the two rectilinear portions 2*a* and 2*b*, respectively. In FIG. 6, the contour of the transverse section of the ceramic base body 1 is defined by a circle, whereas the shape of that part of the transverse section of the ceramic base body 1 which lies between the recesses 5 is defined by an ellipse. This causes a nonsimilarity relationship to be obtained.

As used herein, the term "nonsimilarity" may be taken to mean that the contour of the transverse section of the ceramic base body 1 at the location where the two rectilinear portions 2*a* and 2*b* are arranged is distinct from the shape of the region lying between the recessed wall surfaces formed at least in the midportion (recesses 5) of the opposed inner sides of the two rectilinear portions 2*a* and 2*b*, respectively. More specifically, given that the transverse section of the ceramic base body 1 assumes a circular contour, when the region between the wall surfaces of the recesses 5 assumes a circular shape, a similarity relationship holds on one hand, and, when the region assumes a rectangular or elliptical shape, the nonsimilarity relationship holds on the other hand. It is preferable that the ellipse as mentioned herein has a minor-axis to major-axis ratio of greater than or equal to 1 to 1.2. Moreover, given that the transverse section of the ceramic base body 1 assumes a rectangular contour, when the region between the recesses 5 assumes a rectangular shape and the ratio of the short side to the long side of the rectangle is less than or equal to 20% compared to the ratio of the short side to the long side of the rectangle defining the contour of the transverse section of the ceramic base body, then the similarity relationship holds. On the other hand, when the region assumes a circular or elliptical shape, the nonsimilarity relationship holds. Although the nonsimilarity relationship holds in the case where the region between the recesses 5 assumes a rectangular shape and the ratio of the short side to the long side of the rectangle is greater than 20% compared to the ratio of the short side to the long side of the rectangle defining the contour of the transverse section of the ceramic base body, a circular or elliptical shape is more desirable. In this way, by establishing the nonsimilarity relationship between the contour of the transverse section of the ceramic base body 1 and the shape of the region lying between the recessed wall surfaces formed at least in the midportion (recesses 5) of the opposed inner sides of the two rectilinear portions 2*a* and 2*b*, respectively, it is possible to reduce the likelihood of resonance occurring between the outer part and the inner part of the ceramic base body 1 separated by the heat generation section 2 acting as partition under a shock, and thereby enhance high-temperature strength and durability.

Moreover, it is preferable that the bend portion 2*c* is identical in a transverse sectional configuration with the two rectilinear portions 2*a* and 2*b*. In this case, since there is no difference in level between the bend portion 2*c* and the rectilinear portion 2*a*, 2*b*, it is possible to prevent stress concentration from occurring at the time of expansion of the heat generation section 2 under voltage application, and thereby suppress development of cracks in the ceramic base body 1 (the joint between the bend portion 2*c* and the two rectilinear portions 2*a* and 2*b* of the heat generation section 2). Note that the bend portion 2*c* and the rectilinear portion 2*a*, 2*b* of the heat generation section 2 may be made differently in the transverse section thereof from each other, and a connection part between these portions may connect the different transverse sections of these portions while changing a transverse section of the connection part gradually.

Further, it is preferable that the heat generation section 2 is of higher resistance than the lead portions 3*a* and 3*b*. As used herein, the expression like "higher resistance" may be taken to mean that resistance per unit length is higher. By providing the heat generation section 2 with higher resistance than the lead portions 3*a* and 3*b*, it is possible to impart high-temperature capability to the heat generation section 2 without fail. Besides, since the heat generating resistor has the heat generation section 2 designed in the form according to the invention, it is possible to attain excellent durability without suffering from cracking. Accordingly, there is obtained a highly reliable ceramic heater 10 which excels in heating efficiency.

Hereinafter, an example of the method of manufacturing the ceramic heater 10 in accordance with one embodiment of the invention will be described.

Figure 7:
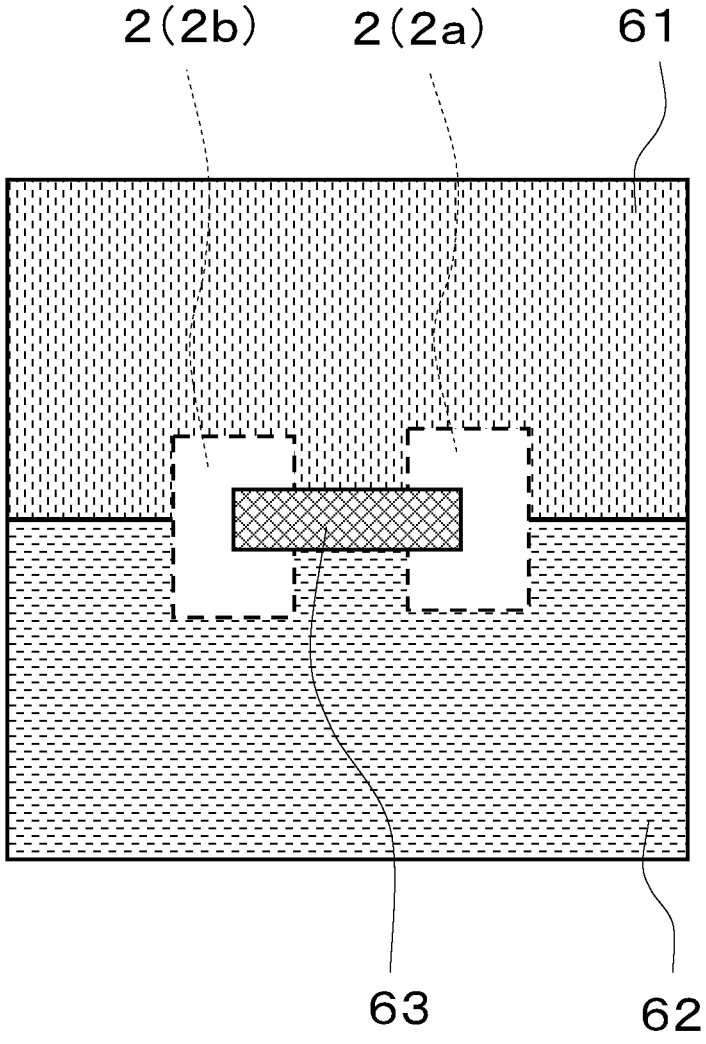
FIG. 7 is a sectional view showing an example of a mold for use in the production of a heat generating element of the ceramic heater of the invention.

To begin with, there is prepared a mold for forming the heat generation section 2 as shown in FIG. 7. The mold is composed of an upper mold 61 and a lower mold 62. When the upper mold 61 and the lower mold 62 are combined together, a cavity which conforms to the shape of the heat generation section 2 (the parallel portions 2*a* and 2*b* in FIG. 7) is formed. In order to achieve formation of the recess 5 in the heat generation section 2 by using such a mold, a spacer 63 for forming the recess 5 is disposed at the mold interface between the upper mold 61 and the lower mold 62. Note that the recess 5 can be formed in the heat generation section 2 by setting the spacer 63 in place with certain latitude relative to the heat generation section 2 which is molded by charging raw material powder into the cavity. Moreover, with flexibility in the determination of the dimension of the spacer 63, the size of the recess 5 can be determined arbitrarily. Likewise, with flexibility in the determination of the length of the spacer 63, the depth of the recess 5 can be determined arbitrarily. For example, after taking a molded product out, the spacer 63 is separated from the molded product, or, with the provision of a sliding mechanism for the spacer within the mold, the separation is effected within the mold.

Using such a mold, a material for forming the heat generation section 2 is charged into the cavity, thereby forming a molded product of the heat generation section 2.

Examples of the material for forming the heat generation section 2 include electrically conductive ceramics such as tungsten carbide (WC), molybdenum disilicide ($MoSi_2$), and tungsten disilicide ($WSi_2$). In the case of using tungsten carbide (WC) to form the heat generation section 2, it is preferable that WC powder is blended with insulating ceramics such as silicon nitride ceramics, which is the major constituent of the ceramic base body 1, for the sake of reducing the difference in thermal expansion coefficient between the heat generation section 2 and the ceramic base body 1. At this time, by making changes to the content ratio between the electrically conductive ceramics and the insulating ceramics, the electrical resistance of the heat generation section 2 can be adjusted to a desired value.

The content ratio-adjusted raw-material powder is charged into the cavity of the mold by press molding or injection molding. In this way, a molded product of the heat generation section 2 can be formed.

On the other hand, a molded product of the ceramic base body 1 is formed, as in the case of the heat generation section 2, by means of heretofore known press molding, injection molding, or otherwise using powder of a ceramic raw material in which a sintering aid composed of rare-earth element oxide such as ytterbium (Yb), yttrium (Y), erbium (Er), or the like is added to alumina powder or silicon nitride powder, for example.

Then, the molded product of the heat generation section 2, which has been molded by using the aforementioned mold (the upper mold 61 and the lower mold 62), is combined with molded products of the lead portions 3*a* and 3*b* molded by using a different mold. The combination is further combined with the molded product of the ceramic base body 1 molded by using a different mold in such a way that the combination is embedded in the molded product, thereby forming a green molded product of the ceramic heater 10.

The green molded product of the ceramic heater 10 thereby obtained is fired in accordance with a predetermined temperature profile so as to obtain the ceramic base body 1 having the heat generation section 2 and the lead portions 3*a* and 3*b* embedded therein. The resulting sintered product is subjected to machining operation on an as needed basis. As a result, the ceramic heater 10 as shown in FIG. 1 is completed. As the method of firing, in the case of using silicon nitride ceramics as ceramics used to form the ceramic base body 1, for example, a hot press method can be adopted. That is, following degreasing process, firing is carried out under a reduction atmosphere in conditions of a temperature in a range of about 1650° C. to 1780° C. and a pressure in a range of about 30 MPa to 50 MPa.

According to the ceramic heater 10 obtained by such a manufacturing method, the two rectilinear portions 2*a* and 2*b* are so configured that at least the midportion of inner sides opposed to each other in a transverse section thereof is shaped into a recess. In this construction, a stress, which is generated at the time of volume expansion of part of the ceramic base body 1 partitioned by the at least the midportion (recess) of the inner sides opposed to each other, can be relaxed by the cushioning effect exerted by the heat generation section 2. Accordingly, in the event of sudden voltage application under abnormal conditions, it is possible to prevent development of cracks resulting from volume expansion of the ceramic base body at its region lying between parts of the heating section 2.

REFERENCE SIGNS LIST

10: Ceramic heater
1: Ceramic base body
2: Heat generation section
  2*a*, 2*b*: Rectilinear portion
  2*c*: Bend portion
3*a*, 3*b*: Lead portion
4*a*, 4*b*: Electrode-taking portion
5: Recess

What is claimed is:

1. A ceramic heater, comprising:

a ceramic base body having a circular cylindrical shape; and a heat generating resistor comprising a heat generation section composed of a bend portion and two rectilinear portions extending from opposite ends of the bend portion, respectively, the heat generating resistor being embedded within the ceramic base body, wherein the two rectilinear portions each comprise a recessed inner elliptical arc side, the respective recessed inner elliptical arc sides of the two rectilinear portions being opposed to each other in a transverse section of the two rectilinear portions, and the two rectilinear portions each have a crescentic shape in the transverse section.

2. The ceramic heater according to claim 1, wherein the bend portion is identical in a transverse sectional configuration with the rectilinear portion.

3. The ceramic heater according to claim 1, wherein the heat generating resistor further comprises lead portions connected to the two rectilinear portions, respectively, and in the heat generating resistor, a resistance of the heat generation section is higher than that of the lead portions.

* * * * *